US005152106A

United States Patent [19]

MacKay, Jr.

[11] Patent Number: 5,152,106

[45] Date of Patent: Oct. 6, 1992

[54] CUT-OFF WHEEL HAVING DISPOSABLE MOUNTING HUB

[76] Inventor: Joseph H. MacKay, Jr., P.O. Box 27497, San Diego, Calif. 92127

[21] Appl. No.: 522,771

[22] Filed: May 14, 1990

Related U.S. Application Data

[63] Continuation-in-part of Ser. No. 212,448, Jun. 28, 1988, Pat. No. 4,924,634, which is a continuation-in-part of Ser. No. 5,812, Jan. 21, 1987, Pat. No. 4,760,670, which is a continuation-in-part of Ser. No. 847,793, Apr. 3, 1986, Pat. No. 4,694,615.

[51] Int. Cl.[5] ..... B24D 5/16

[52] U.S. Cl. ..... 51/168; 51/378

[58] Field of Search ..... 51/168, 206 R, 209 R, 51/358, 378, 376, 377, 389

[56] References Cited

U.S. PATENT DOCUMENTS

| | | | |
|---|---|---|---|
| 2,810,239 | 10/1957 | Burleigh | 51/168 |
| 3,653,858 | 4/1972 | Field | 51/378 |
| 3,879,178 | 4/1975 | Bosma | 51/168 |
| 4,015,371 | 4/1977 | Grayston | 51/168 |
| 4,541,205 | 9/1985 | Patrello | 51/209 R |
| 4,637,170 | 1/1987 | Block | 51/168 |
| 4,655,006 | 4/1987 | Block | 51/168 |
| 4,729,193 | 3/1988 | Gant et al. | 51/168 |

FOREIGN PATENT DOCUMENTS

| | | | |
|---|---|---|---|
| 0005183 | 12/1926 | Australia | 51/168 |

*Primary Examiner*—Robert A. Rose

*Attorney, Agent, or Firm*—Robbins, Dalgarn, Berliner & Carson

[57] ABSTRACT

A disposable cut-off wheel for mounting on a rotatable threaded spindle which may be used with a power tool. The cut-off wheel includes a central aperture which contains a threaded nut having a flange at one end non-removably secured thereto without the aid of adhesives in such a manner that the cut-off wheel is placed in compression when it is operably secured upon the spindle under operational loads. The nut is secured to the cut-off wheel by upsetting one end of the nut causing it to protrude outwardly over the rear surface of the cut-off wheel or into engagement with the aperture. A generally inverted cup shaped supporting flange is carried by the spindle for engaging the outer surface of the cut-off wheel during operation of the cut-off wheel. A plastic washer like insert member is received within and carried by the supporting flange and provides a bearing between the lip of the supporting flange and the cut-off wheel.

8 Claims, 3 Drawing Sheets

CUT-OFF WHEEL HAVING DISPOSABLE MOUNTING HUB

RELATED APPLICATION

This application is a continuation-in-part of U.S. patent application Ser. No. 212,448, filed Jun. 28, 1988 for FINISHING ARTICLE HAVING AN INTEGRAL MOUNTING HUB AND IMPROVED BASE, now U.S. Pat. No. 4,924,634 which is a continuation-in-part of U.S. patent application Ser. No. 005,812 filed Jan. 21, 1987 for DISPOSABLE DEPRESSED CENTER GRINDING WHEEL HAVING AN INTEGRAL MOUNTING HUB, now U.S. Pat. No. 4,760,670 which is a continuation-in-part of U.S. patent application Ser. No. 847,793, filed Apr. 3, 1986 for DISPOSABLE DEPRESSED CENTER GRINDING WHEEL HAVING AN INTEGRAL MOUNTING HUB, now U.S. Pat. No. 4,694,615.

FIELD OF THE INVENTION

This invention relates generally to abrasive grinding articles and more particularly to a cut-off wheel with a disposable mounting hub permanently affixed thereto with the combination adapted for attachment to an appropriate portable power tool.

BACKGROUND OF THE INVENTION

The use of rotatably driven finishing articles and particularly grinding and cut-off wheels is widespread and familiar in our industrial society. One of the more serious problems encountered in the use of such devices resides in the provision of effective means for preventing undesired or accidental disassociation of the cut-off wheel or grinding wheel from the shaft, spindle or other rotatable drive means on which it is mounted. This problem is particularly acute when the connection between the cut-off wheel or grinding wheel and its driving shaft or spindle is intentionally detachable to facilitate quick removal and replacement of the wheel. Into this category fall a host of devices, for example, portable powered grinders wherein the grinding or cut-off wheels employed are intentionally detachable from a power driven shaft so that they may be readily replaced. To properly mount the cut-off wheel upon the shaft provision must be made to provide sufficient clamping force and also to secure the wheel rotationally while permitting quick and easy detachment when spent.

One means of securing such devices to the drive shaft has been to provide an appropriate backing flange with a central opening which is aligned with an opening provided in the device. A bolt or nut member (depending upon the configuration of the drive shaft, that is, whether it is externally or internally threaded) is inserted from the face side of the device and is then tightened in place. In this manner a plurality of loose parts are configured in a completed assembly ready for use. As the wheel is utilized the appropriate clamping force is provided to securely affix the grinding wheel to the drive shaft. Such an assembly of parts has been used for large grinding wheels as well as small cut-off wheels. Such an assembly, however, typically requires appropriate tools such as wrenches or the like to remove the grinding wheel from the drive shaft. Such a device is shown in U.S. Pat. Nos. 3,596,415; 1,998,919; 566,883; 507,223; 1,162,970; 791,159; 489,149 and 3,210,892.

Subsequently it became desirable to affix the mounting hub permanently to the grinding wheel so that the entire unit may be quickly and easily attached and detached from the drive shaft and discarded when the grinding wheel has been worn down. In these types of devices it is customary to utilize an adhesive such as an epoxy resin or the like between the backing flange and the back surface of the grinding wheel to retain integrity between the mounting hub and the grinding wheel to secure the wheel rotationally.

Even though the adhesive tended to work quite well in most applications, it was discovered that in some instances the adhesive would break loose and the grinding wheel would rotate relative to the mounting hub. Such was particularly the case since the hub was a one-piece member which was internally threaded and held in place upon the grinding wheel by swaging an extension thereof into place, thus providing a fixed clamping force holding the grinding wheel. No additional clamping force was exerted during further rotation of the wheel during use as was the case with the traditional nut which was secured from the face as above described. As a result various keyways and corresponding key structures were developed between the wheel and the mounting hub and used in conjunction with the adhesive to preclude rotational movement between the mounting hub and the grinding wheel. Examples of such devices are shown in U.S. Pat. Nos. 3,136,100; 4,015,371; 2,278,301; 3,081,584; 3,500,592; 3,800,483; 4,240,230 and 4,541,205. Although these devices have been used with grinding wheels, the cost has precluded their use with cut-off wheels.

Additional prior art patents known to applicant are U.S. Pat. Nos. 3,041,797; 3,879,178; 1,724,742; 3,912,411; 3,879,178; 3,960,516; 4,026,074; 4,054,425; 4,088,729; 4,322,920; 4,439,953; 4,601,661; 791,791; 872,932; 2,567,782; 3,136,100, 3,210,892 and 3,621,621.

The devices utilized in the prior art for providing the disposable wheel assembly including the permanently affixed mounting hub generally provide the service intended. There are certain inherent disadvantages found with regard to the various devices. Such disadvantages are that in manufacturing the utilization of an adhesive adds additional materials and labor to the cost of manufacturing. In certain of the devices, parts must be keyed together and properly aligned in order to function appropriately. In addition thereto, through the utilization of die-cast mounting hubs which include as an integral part the backing flange there is no additional clamping force exerted upon the grinding wheel as it is being rotated by the power tool. Furthermore, such die-cast mounting hubs are relatively bulky, take up space and add substantial weight and additional cost to the completed product. As a result, cut-off wheels, which are relatively small and in-expensive, are still utilized as an assembly of parts requiring tools to assemble and disassemble the wheel from the spindle.

SUMMARY OF THE INVENTION

A cut-off wheel having a drive member non-removably affixed thereto for mounting on a spindle for rotation by a power tool. The drive member includes a nut which extends through an opening in the finishing article and has an outwardly extending radial flange at one end thereof seated against the face of the article. Means is provided at the other end of the nut for non-removably securing the retaining nut and flange on the wheel without the use of adhesives. A base member or adapter carried by the spindle engages the opposite surface of the wheel to apply pressure to the wheel during operation of the cut-off grinding wheel. More particularly, the base member or adapter is an integral inverted cup shaped member which includes a plastic surface for engaging the opposite surface of the wheel. The plastic surface is preferably provided by a plastic cap which is inserted into the cup shaped member.

DETAILED DESCRIPTION

Figure 1:
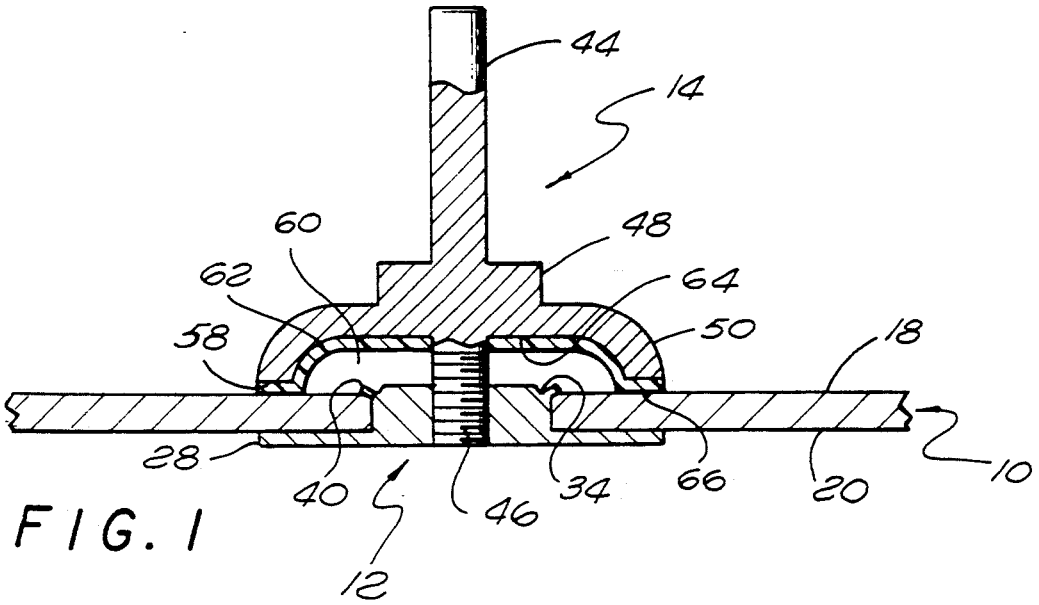
FIG. 1 is a cross sectional view of a disposable cut-off wheel assembly constructed in accordance with the principles of the present invention and mounted in operable position on a spindle which may be affixed to a portable power tool.

The present invention is particularly adapted for use as a cut-off wheel or the like. By reference now more specifically to FIGS. 1 through 5, there is illustrated a disposable cut-off wheel having a drive member assembly constructed in accordance with the principles of the present invention. As is therein shown a cut-off wheel 10 has a disposable drive member assembly 12 permanently affixed thereto so that the grinding wheel may be attached to a spindle 14 which in turn is secured to the chuck of an appropriate power tool (not shown) as well known to those skilled in the art. According to the principles of the present invention, a disposable mounting hub or drive member 12 is constructed in such a manner that when the cut-off wheel is placed in operation upon the spindle 14 the cut-off wheel 10 is placed in compression and the more force is applied to the grinding wheel during utilization thereof, the greater the operational compression becomes. As a result of placing the cut-off wheel in such compression the cut-off wheel is maintained upon the spindle and cannot fly off and at the same time, through the compression or clamping force as applied, the cut-off wheel 10 cannot rotate relative to the driving member or hub 12. However, as a result of the construction of the driving member assembly, the spent cut-off wheel may be easily removed from the spindle 14 for disposal without the utilization of hand tools or the like.

As is clearly shown, the cut-off wheel 10 includes a back surface 18 and a front surface 20. A centrally located aperture 22 is provided in the center portion of the cut-off wheel 10.

Figure 2:
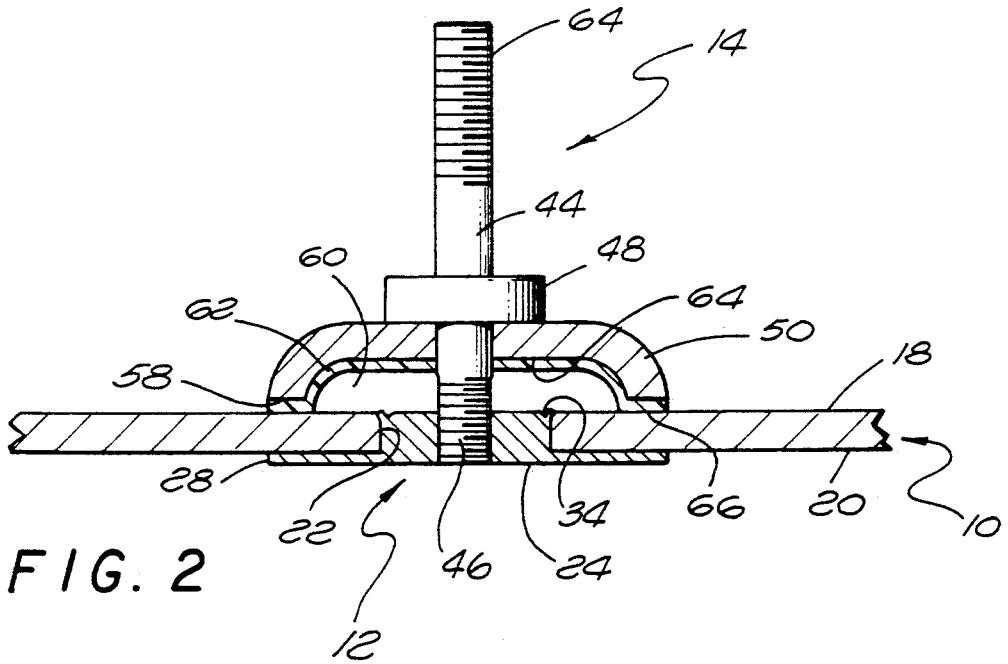
FIGS. 2 and 3 are similar to FIG. 1 but illustrate alternative embodiments.
Figure 3:
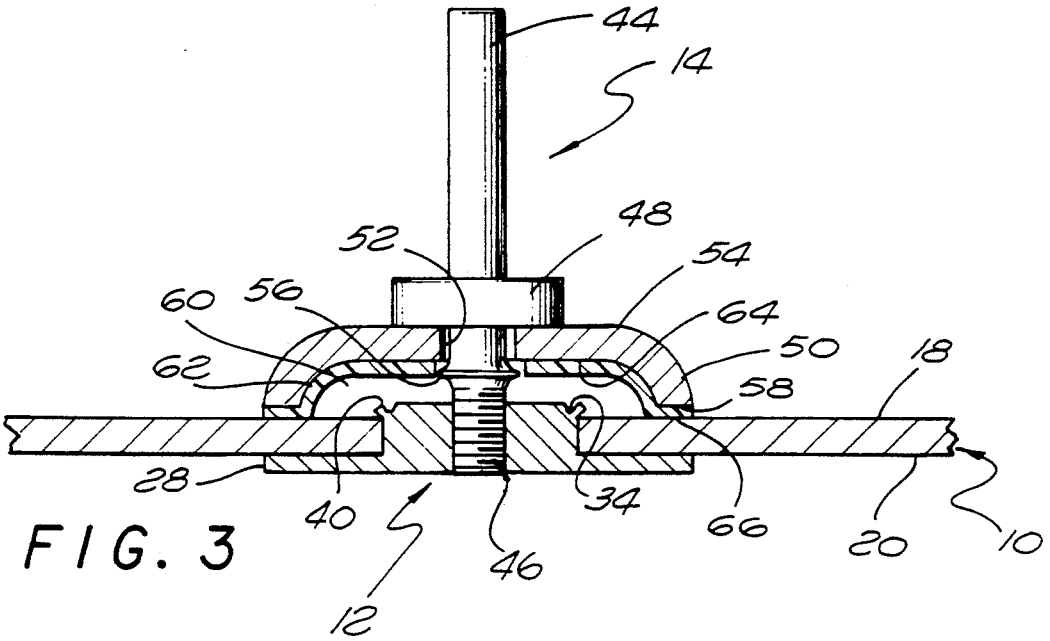
Figure 5:
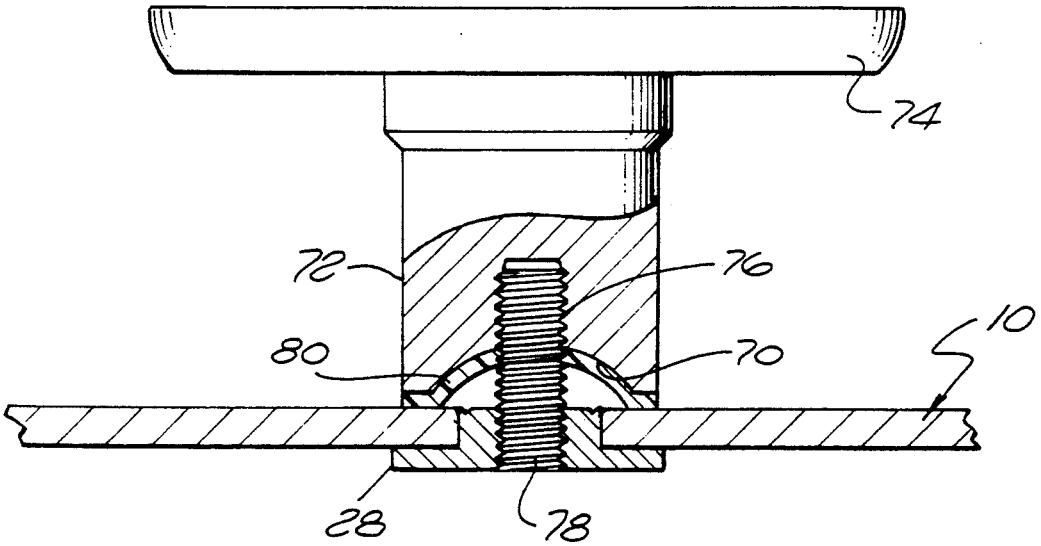
FIG. 5 is a cross sectional view of another alternative embodiment of a cut-off wheel in accordance with the present invention.

A retainer nut 24 includes a body portion 26 which is hollow and has a radially outwardly extending flange 28 at a first end 50 thereof. At the opposite or second end 32 of the body portion 26 there is provided a recess such as a continuous groove 34 which is formed at the time of assembly after the body portion 26 is inserted through the opening 22 in the cut-off wheel 10. The internal surface of the body 26 has threads 36 formed therealong for attachment to the threaded portion 38 & spindle 14 of the power tool. The nut 24 is inserted through the aperture 22 in the cut-off wheel from the front 20 toward the rear 18 of the cut-off wheel 10. The end 52 of the nut 44 may extend through the opening 20 in the cut-off wheel 10 for a short distance as illustrated in FIGS. 1 and 3 or may be substantially flush with the rear surface thereof as illustrated in FIGS. 2 and 5.

Once the nut 24 has been inserted through the opening 22 in the cut-off wheel 10, the flange 28 is held firmly against the front face 20 of the cut-off wheel 10 and the end 32 of the nut 24 is upset, such as by a staking operation, to secure the nut 24 to the cut-off wheel 10. The upsetting operation causes a protrusion 40 (FIGS. 1 and 3) to extend outwardly from the body 26 in such a manner as to engage the back surface 18 of the cut-off wheel 10 adjacent the opening 22 therethrough and is the only means used for securing the nut 24 on the cut-off wheel 10. The protrusion 40 is illustrated as being continuous as is the groove 34, although it should be understood that it may be intermittent should such be desired. As is shown in FIG. 2, the staking operation forming the groove 34 enlarges or spreads the top 32 of the nut body 26 to force it into engagement with the top edge 42 of the aperture 22 in the cut-off wheel 10. In either construction, the nut 24 is secured to the cut-off wheel 10 without the use of adhesives and in such a manner that the body 26 of the nut 24 may move from the face 20 toward the rear 18 of the cut-off wheel 10 during the application of operational forces as will be described more fully below.

The nut 24 is preferably constructed from a metal die casting or may be constructed from an aluminum extrusion which is then machined to provide the flange 28 and the threads 36.

To provide proper operation of the throw-away cut-off wheel as described, there is provided a spindle assembly 14 which includes a shank 44 (FIG. 3) for insertion into and gripping by the chuck or collet of a hand held power tool (not shown). The shank 44 also includes a lower threaded portion 46. The shank 44 and the threaded portion 46 are separated by a collar 48. A support flange in the form of an inverted cup shaped member 50 is held in position loosely upon the threaded portion 46 beneath the collar 48. When the spindle 14 is assembled, the threaded shank 46 is inserted through the opening 52 in the support flange 50 until the collar 48 rests against the rear surface 54 thereof. A staking tool is then inserted over the threads 46 and the shaft is upset to provide a radial protrusion as shown at 56, which may be continuous or discontinuous, thereby to loosely retain the supporting flange 50 on the threaded shank 46. The support flange 50 utilized in this instance is preferably constructed of metal as is illustrated and may be stamped, milled or die cast as desired.

A plastic washer like member or insert 62 is provided on the interior surface 64 of the support flange 50. The insert 62 may be a separately molded member which is snapped into place and held by friction only, or alternatively may be plastic which has been coated as by spraying, dipping, or the like upon the interior surface 64 of the support flange 50. Preferably, the molded washer like member is utilized.

When the molded insert is utilized, it is pushed or snapped in place and provides a bearing 66 between the surface or lip 58 of the cup shaped supporting flange 50 and the back surface 18 of the cut-off wheel 10. With such a bearing surface of dissimilar materials, the cut-off wheel 10 is easily removed from the spindle assembly 14 upon being spent by the application of simple hand force, that is, no additional tools of any type are needed to remove the spent cut-off wheel 10 from the spindle assembly 14. As a result, cut-off wheels may be quickly and easily replaced during operation, thus speeding up cut-off operations by a substantial amount. Through utilization of the molded insert member 62, as cut-off wheels are placed on and removed from the spindle assembly 14, the bearing surface 64 will become worn. When the bearing surface becomes worn by a substantial amount, the insert 62 may be easily removed and replaced, thus prolonging the life of the spindle assembly 14.

The plastic washer like insert 62 may be constructed from any plastic material desired. Such, for example, as polytetrofluoroethylene, polyvinylchloride, polyethylene or the like which will provide a self-lubricating characteristic.

To commence use of a cut-off wheel constructed in accordance with the principles of the present invention, the user merely threads the nut 24 on to the threaded end 46 of the shank 44 and snugs the back 18 of the wheel 10 against insert 62 on the cup surface 58 of the support flange 50.

Upon commencing use, there may be some relative rotation between the cut-off wheel 10 and the shank 44 which would increase the compression between the flange 28 and the surface 58 to hold the cut-off wheel 10 securely.

The force necessary to cause the cut-off grinding wheel 10 to be placed in compression is generated upon attachment of the spindle assembly 14 to the threads 36 in the nut 24. By reference to FIG. 1, it will be noted that when the cut-off wheel is threaded upon the spindle 14 the surface 58 on the support flange 50 engages the surface 18 on the cut-off wheel 10. The flange 50 is forced in a downward direction by such engagement. At the same time the interengagement between the threads 46 and 36 of the spindle and nut, respectively, urge the nut 24 upward toward the flange 50 to cause the cut-off wheel to be placed in compression between the supporting flange 50, surface 58 and the radial flange 28 on the nut 24. An examination of the drawings, particularly FIG. 1, will disclose that when the cut-off wheel is in operation forces are transmitted downwardly from the collar 48, the support 50 and the surface 58. At the same time, forces are being applied upwardly through the flange 28 on the nut 24. These forces are generated through the threaded engagement between the spindle 14 threads 46 and the interior threads 36 of the nut 24 through application of torque to the rotating cut-off wheel 10 when it is placed into engagement with a workpiece. Those skilled in the art will recognize that as the cut-off wheel 10 is used by being placed against a workpiece additional torque is generated causing the cut-off wheel to be further tightened onto the spindle assembly 14. That is, as the cut-off wheel 10 moves during contact with a workpiece, the friction between the nut and the cut-off wheel center causes the nut to rotate in a further tightening direction. Such rotation of the nut further urges the nut 24 toward the flange 50 which in turn applies a further force to the wheel 10. The more the cut-off wheel is tightened the greater the operational compression force becomes and the more securely the cut-off wheel 10 is clamped. As a result of this strong clamping or compression the cut-off wheel 10 is precluded from movement relative to the hub or driving member 12 and at the same time is precluded from disengaging from the spindle assembly 14. It should also be noted that the inner surface of the cup shaped member 50 provides a space or chamber 60 above the top 32 of the nut 24. This chamber 60 provides room for the nut to move upwardly during operation in a manner unrestricted by the spindle assembly 14.

By reference to FIG. 2 there is shown an alternative embodiment of a cut-off wheel constructed in accordance with the present invention. The same reference numerals used in FIG. 1 are used in FIG. 2 with respect to similar components. As therein shown, the support flange 50 is provided with an opening 62 which is of the same diameter as the shank 44. In assembly the support flange 50 is press fitted onto the shank 44 and thereby provides an interference fit therebetween. This structure rigidly secures the support flange 50 and shank 44 together as opposed to the loose retention of FIG. 3. As is shown in FIG. 2, the shank 44 is threaded at 64 for reception by an internally threaded opening in a spindle of a power tool.

As is clearly shown in FIG. 1, the spindle assembly 14 may be constructed of a single unitary member as by casting or milling from bar stock. Again, as in FIG. 2, the adapter would be rigid in character.

Figure 4:
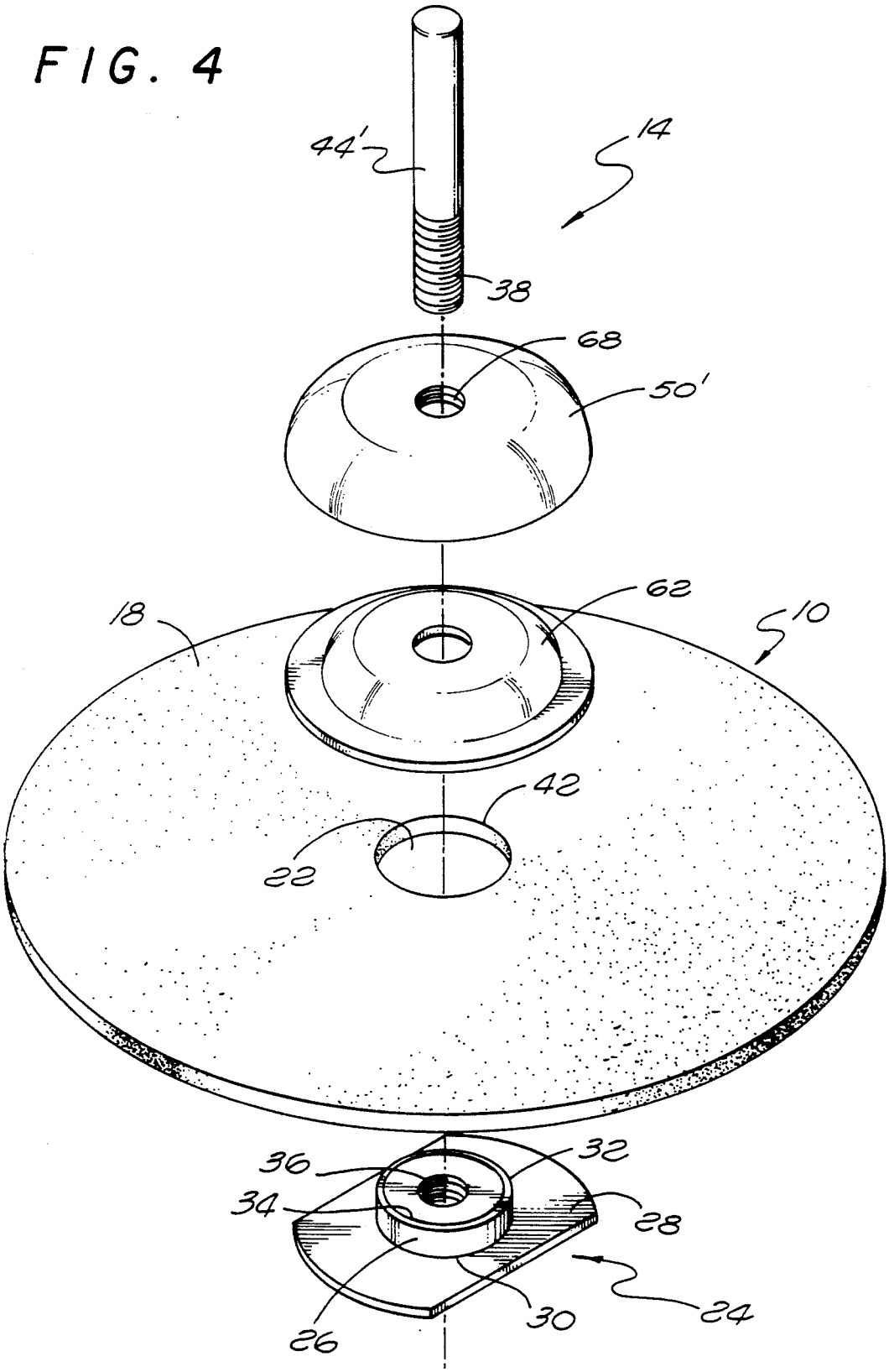
FIG. 4 is an exploded view of yet another alternative embodiment of a cut-off wheel prior to assembly thereof.

As is illustrated in FIG. 4, to which reference is hereby made, the spindle assembly may be constructed from a shank 44' having the threaded end 38 which is threaded into a threaded opening 68 provided in the support flange 50'. The washer like molded plastic insert member 62 would be snapped into place internally of the supporting flange 50' as is shown in FIGS. 1 and 2. Again, through the utilization of a shaft or shank 44' as illustrated in FIG. 4, the combination of the shank 44' and the supporting flange 50' would provide a rigid spindle assembly 14 as above described.

If desired, as shown in FIG. 5, the inverted cup shaped supporting flange may be formed as shown at 70 in the spindle 72 of the power tool 74. An internally threaded opening 76 is provided in the spindle 72 and a threaded stud 78 is inserted into the threaded opening 76. Thereafter a cut-off wheel 10 with a nut 24 relatively movably secured therein is threadably secured upon the stud 78. As can be seen, the cup shaped member 70 in the power tool spindle 72 functions precisely the same as the support flange 50 of FIGS. 1 and 4. To provide ease of removal of the cut-off wheel 10 there is provided a molded plastic insert 80 which conforms to the contour of the surface 70 formed in the spindle 72. The insert 80 functions in the same manner as the insert 62 previously described.

It should be noted from the illustrations that the diameter of the flange 28 on the nut 24 is at least equal to the diameter of the lip 58 on the support flange 50 or the member 70 (FIG. 5). By matching these diameters, the forces generated during operation function as true clamping forces applied to the cut-off wheel 10 to place it in compression as described above. If the diameter of the flange 28 is smaller than the diameter of the lip 58, the forces generated would tend to pull the nut through the center of the cut-off wheel and render it inoperative.

It will be recognized by those skilled in the art that the cut-off wheel assemblies as illustrated in FIGS. 1 through 5 and as above described require no adhesive for construction and may be simply and easily assembled, are relatively light in weight and provide a secure attachment of the cut-off wheel to the spindle assembly and through the utilization of the increased compression precludes relative rotation of the cut-off wheel with regard to the driving member. It has also been discovered that the utilization of the device as above described and as constructed in the various embodiments is extremely smooth in operation with no vibration. The reason for such extremely smooth operation is that all of the parts are perfectly aligned one with the other with the abutting surfaces parallel when in compression and only the wheel 10 can cause any vibration and then only if it is not properly balanced during the construction thereof.

There has thus been disclosed a disposable cut-off wheel-driving member assembly which securely holds the cut-off wheel during operation, which is light in weight, vibration-free, and is inexpensive while meeting all safety standards currently known and in existence.

What is claimed is:

1. The combination of a cut-off wheel having a disposable drive member non-removably affixed thereto for mounting on a threaded rotatable spindle and a supporting flange, said combination for use with a power tool and comprising:

a solid cut-off grinding wheel having a face and a back and defining a centrally disposed aperture therethrough having an inner surface;

a nut having an outer diameter and a hollow internally threaded body having first and second ends and a first radially outwardly extending flange extending from said first end of said body, said body extending through said aperture of said cut-off wheel with said first radial flange seated against said face, said first radial flange having a first predetermined outer diameter;

said second end of said body being upset to non-removably secure said nut on said cut-off wheel without the use of adhesives while allowing relative axial movement between said nut and said cut-off wheel;

a supporting flange having a second predetermined outer diameter carried on said spindle for applying force to said cut-off wheel when said cut-off wheel is threadably affixed to and seated on said spindle, whereby relative axial movement between said nut and said supporting flange toward each other is permitted to thereby increasingly compress said cut-off wheel as operative loads are applied to said cut-off wheel during use on said power tool; and a plastic insert member having a lip having an inner diameter and providing a bearing surface between said supporting flange and said cut-off wheel to permit easy removal of said cut-off wheel from said spindle without the use of tools, said first predetermined outer diameter of said outwardly extending flange on said nut being at least equal to said second predetermined outer diameter of said supporting flange, and said outer diameter of said body of said nut being less than said inner diameter of said lip of said plastic insert.

2. The combination as defined in claim 1 wherein said second end of said body is expanded by said upsetting to engage said inner surface of said aperture.

3. The combination as defined in claim 1 wherein said second end of said body is expanded by said upsetting to overlap said back of said cut-off wheel adjacent said aperture.

4. The combination as defined in claim 1 wherein said supporting flange includes a metallic body and said plastic insert is a molded plastic insert extending over said supporting flange.

5. The combination as defined in claim 4 which further includes means for loosely retaining said supporting flange on said spindle.

6. The combination as defined in claim 5 wherein said means for loosely retaining said supporting flange includes a radial protrusion on said spindle.

7. The combination as defined in claim 4 wherein said supporting flange is integral with and carried by said spindle.

8. The combination as defined in claim 4 wherein said supporting flange is secured on said spindle by an interference fit therebetween.

* * * * *